US006362739B1

(12) United States Patent
Burton

(10) Patent No.: US 6,362,739 B1
(45) Date of Patent: Mar. 26, 2002

(54) PASSIVE SECURITY DEVICE FOR DETECTING FERROMAGNETIC OBJECTS

(76) Inventor: Garry L. Burton, P.O. Box 202, Harmony, RI (US) 02829

( * ) Notice: Subject to any disclaimer, the term of this patent is extended or adjusted under 35 U.S.C. 154(b) by 0 days.

(21) Appl. No.: 09/401,621

(22) Filed: Sep. 22, 1999

(51) Int. Cl.[7] ..... G08B 13/14

(52) U.S. Cl. ..... 340/572.6; 340/572.1; 340/572.8; 340/551

(58) Field of Search ..... 340/572.6, 572.1, 340/572.2, 572.4, 572.5, 572.7, 572.8, 551; 324/243

(56) References Cited

U.S. PATENT DOCUMENTS

| | | | | | |
|---|---|---|---|---|---|
| 3,430,221 | A | | 2/1969 | Barringer et al. | |
| 3,697,996 | A | | 10/1972 | Elder et al. | |
| 3,839,700 | A | * | 10/1974 | DeLorenzo et al. | 340/933 |
| 3,971,983 | A | | 7/1976 | Jaquet | |
| 4,012,690 | A | | 3/1977 | Heytow | |
| 4,024,468 | A | | 5/1977 | Hirschi | |
| 4,060,039 | A | | 11/1977 | Lagarrigue | |
| 4,357,535 | A | | 11/1982 | Haas | |
| 4,449,115 | A | * | 5/1984 | Koerner | 340/941 |
| 4,605,898 | A | | 8/1986 | Aittoniemi et al. | |
| 4,821,023 | A | | 4/1989 | Parks | |
| 4,837,556 | A | * | 6/1989 | Matsushita et al. | 340/310.01 |
| 4,866,424 | A | * | 9/1989 | Parks | 340/551 |
| 4,906,973 | A | | 3/1990 | Karbowski et al. | |
| 5,039,981 | A | * | 8/1991 | Rodriguez | 340/551 |
| 5,121,105 | A | | 6/1992 | Aittoniemi | |
| 5,498,959 | A | | 3/1996 | Manneschi | |
| 5,521,583 | A | | 5/1996 | Frahm et al. | |
| 5,552,705 | A | | 9/1996 | Keller | |
| 5,552,766 | A | | 9/1996 | Lee et al. | |
| 5,689,184 | A | | 11/1997 | Jeffers et al. | |
| 5,747,719 | A | | 5/1998 | Bottesch | |
| 5,790,685 | A | * | 8/1998 | Sallee | 382/100 |
| 5,831,431 | A | * | 11/1998 | Gottfried et al. | 324/239 |
| 5,841,346 | A | | 11/1998 | Park | |
| 5,868,360 | A | * | 2/1999 | Bader et al. | 246/202 |
| 5,877,706 | A | * | 3/1999 | Summersgill | 340/933 |

* cited by examiner

*Primary Examiner*—Nina Tong
(74) *Attorney, Agent, or Firm*—Salter & Michaelson

(57) ABSTRACT

A device for detecting the presence of a ferromagnetic object comprising at least one coil formed from a multiple winding of a wire and a controller comprising an alarm. The coil is constructed and arranged such that, upon the relative motion of the ferromagnetic object proximate the at least one coil, a voltage induced in the coil is transmitted to the controller, and controller is constructed and arranged to determine whether the induced voltage falls within a predetermine range and, if so, to trigger the alarm.

14 Claims, 4 Drawing Sheets

PASSIVE SECURITY DEVICE FOR DETECTING FERROMAGNETIC OBJECTS

FIELD OF THE INVENTION

The present invention relates generally to ferromagnetic object detectors and more particularly to a passive coil inductor system for detecting ferromagnetic objects which are passed through the system or to which the system is passed in proximity.

DISCUSSION OF THE RELATED ART

Metal detectors are used for security purposes in a number of locations, such as airports, federal buildings, banks, schools and other high-security installations. Currently, there are two types of metal detectors in use in such installations. The first type includes a transmitting coil located on one side of the detector and a receiving coil located on the opposite side of the detector. Typically, the magnetic field is generated on one side of the detector by the transmitting coil, and the generated field is received on the other side of the detector by the receiving coil. As long as the magnetic field received by the receiving coil is within the predetermined parameters programmed into the detector, an alarm is not actuated. However, the passage or presence of a ferromagnetic object through or in the magnetic field causes a disturbance in the field received by the receiving coil. If this disturbance causes the magnetic field to fall outside of the predetermined parameters, the alarm associated with the detector is actuated.

Another type of ferromagnetic metal detector is disclosed in U.S. Pat. No. 3,971,983 to Jaquet. This detector employs a number of gradiometers positioned on both sides of a walk-through portal. While this device does not actively generate a magnetic field within the portal, the gradiometers monitor the magnetic field generated by the earth. Any disturbances in the earth's magnetic field, such as may be caused by the presence of a ferromagnetic object within the portal, are detected by the gradiometers, resulting in the activation of an alarm.

While these types of detector systems can be very accurate, the operation of and hardware associated with the system are very complex and these systems are very expensive to manufacture and operate. Furthermore, these systems can be very sensitive to changes in the magnetic field which occur outside of the detectors and which are not caused by the contraband which the detectors are designed to detect, thereby resulting in undesired false alarms.

What is needed therefore is a ferromagnetic metal detecting system which is inexpensive to manufacture and operate and which results in less false detections and consequently, less false alarms.

SUMMARY OF THE INVENTION

The present invention includes a ferromagnetic metal detector which is simple and inexpensive to manufacture and operate and which is also less prone to interference from ferromagnetic materials which are not passed through the detector. The simple design of the invention also allows the detector to be easily transportable, thereby allowing the detector to be moved between different locations that require monitoring. The detector of the present invention includes a pair of vertically aligned inductive coils located to define a passageway therebetween. The inductive coils are electrically coupled together and to a control device. Movement of a ferromagnetic object in proximity of the inductive coils induces a voltage within the coils, which voltage may then used to activate an alarm.

According to one embodiment of the invention, a device for detecting the presence of a ferromagnetic object is disclosed, comprising at least one coil formed from a multiple winding of a wire and a controller comprising an alarm. The coil is constructed and arranged such that, upon the relative motion of the ferromagnetic object proximate the at least one coil, a voltage induced in the coil is transmitted to the controller, and controller is constructed and arranged to determine whether the induced voltage falls within a predetermine range and, if so, to trigger the alarm.

Other features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

DETAILED DESCRIPTION

The present invention takes advantage of the relationship between inductive coils and ferromagnetic materials. It is well-known that, when a coil is exposed to a magnet, two things can occur. First, if there is no relative movement between the magnet and the coil, no voltage is generated in the coil, and therefore, no current flows in the coil. However, if there is relative movement between the coil and the magnet, meaning that either the coil is held still and the magnet moved, or the magnet is held still and the coil is moved so that the windings of the coil cross the magnetic lines of force of the magnet, a voltage, called the induced emf, is generated in the coil, resulting in a flow of current in the coil.

The present invention takes advantage of this physical phenomena and of the fact that most ferrous weapons, including guns and knives, have built into their domain structure a certain level of magnetic bias which results in a measurable magnetic field which exists in the surrounding space, by using the induced emf to actuate an alarm which indicates the presence of a ferromagnetic material proximate the coils associated with the invention, as will be described in greater detail below.

Figure 3:
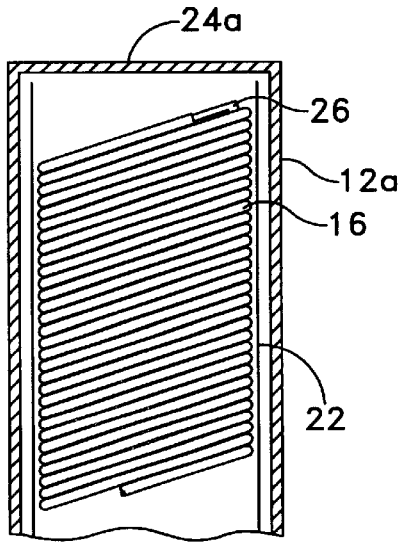
FIG. 3 is a cutaway view of the invention, showing a coil inductive sensor without a highly magnetically permeable cylindrical coil, taken along lines 2—2 in FIG. 1.

Referring now to the figures, and more particularly to FIGS. 1–3, a first embodiment of the walk-through metal detector, generally indicated at 10, of the invention will be described. The detector 10 includes a pair of upright columns 12*a* and 12*b*, which are mounted on platforms 14*a* and 14*b*, respectively, for stability. The columns and supports 12*a*, 12*b* and 14*a*, 14*b*, respectively, are preferably formed from a non-magnetic material such as plastic, so as to not interfere with the operation of the detector 10. Each column 12*a*, 12*b* houses a coil inductive sensor 16, partially shown in FIG. 2, which is a cutaway view of the column 12*a* as seen along line 2—2 in FIG. 1. An identical coil inductive sensor is housed in column 12*b*.

Figure 2:
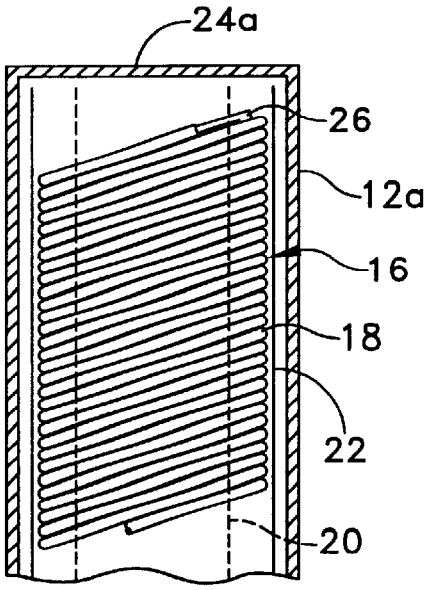
FIG. 2 is a cutaway view of the invention, showing a coil inductive sensor including a highly magnetically permeable cylindrical coil, taken along lines 2—2 in FIG. 1.
Figure 4:
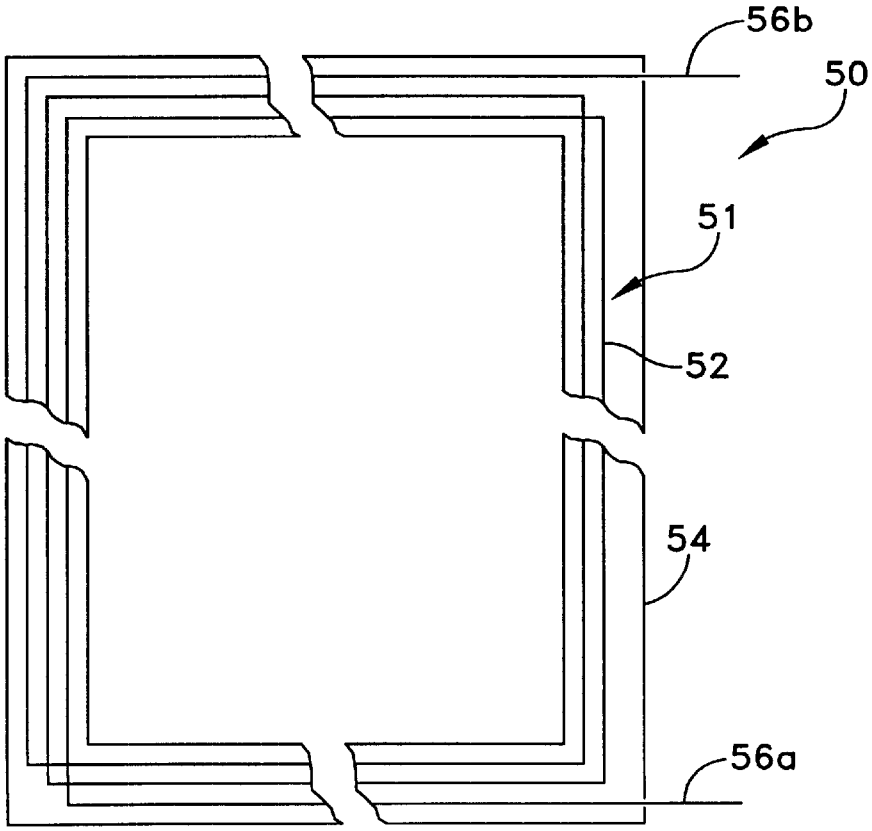
FIG. 4 is a partial view of a second embodiment of the present invention, including a large-scale multi-winding coil sized to allow a person to step through the coil.

As can be seen in FIG. 2, the coil inductive sensor includes a single coil multilayer winding of wire 18 wound onto a highly magnetically permeable core, shown in phantom at 20 in FIG. 2. The sensor could also be formed without the highly magnetically permeable core, as shown in FIG. 3. The sensor 16 also includes a shield 22 which completely surrounds the coil to shield the coil sensor from undesired high frequencies which could interfere with the operation of the sensor while allowing the very low frequencies from the intrinsic magnetic fields emitted from personally carrier items to pass through to the sensors relatively unattenuated. Preferably, this non-magnetic highly conductive shield 22 is formed from a material such as aluminum.

The coil inductive sensor 16 in each column 12*a* and 12*b* can span the entire length of the column, which preferably is approximately 6 feet in length. Alternatively, the coil inductive sensor 16 can include a series of smaller coil sensors spaced along the column 12*a* and 12*b*. At the upper end 24*a*, 24*b* of each column, the wire which forms the coil 18 is fed back down through the coil as indicated at location 26, for connection to the controller 30 of the system, which will be described in greater detail below. As can be seen in FIG. 1, the sensors located in the columns 12*a* and 12*b* are electrically connected to each other by a shielded cable 32 and then to the controller 30 by a shielded cable 34. Both ends of the wire 18 which forms the coil sensor 16 located in the column 12*a* are electrically connected to the controller 30 through the shielded cables 32 and 34. Likewise, both ends of the wire 18 which forms the coil sensor 16 located in the column 12*b* are electrically connected to the controller 30 through the shielded cable 34. Power is supplied to the controller 30 via a typical wall plug 31.

As described above, the detector 10 is a passive detector and therefore only requires power to run the controller 30. In operation, the columns are set on the floor at an entryway or other security checkpoint. The shielded cable 32 has a length which allows the columns 12*a* and 12*b* to be spaced approximately three feet apart. As people pass between the columns 12*a* and 12*b*, the relative movement of any ferromagnetic materials being carried through the detector will induce a voltage in either or both of the coils 16 of the columns 12*a* and 12*b*. The resulting current in the coils 16 is fed through the shielded cables 32 and 34 to the controller 30 for processing.

Figure 8:
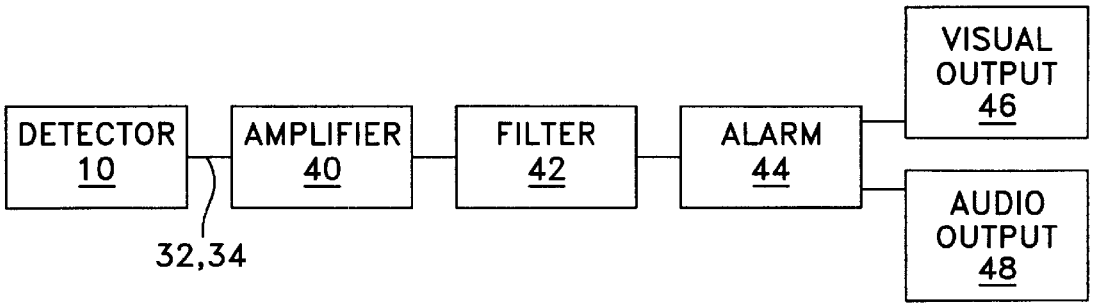
FIG. 8 is a block diagram showing the components of a control device of the invention.

The controller 30 will now be described with reference to FIG. 8, which is a block diagram of the components of the detector of the present invention. As shown in FIG. 8, the controller 30 includes an amplifier 40, a tunable filter 42 and an alarm device 44, which includes a visual output 46 and an audio output 48. Upon the relative motion of a ferromagnetic device proximate the coil inductive sensors 16, a voltage is induced in the sensors. The resulting current is then supplied to the amplifier 40 through the shielded cables 32 and/or 34. The current is amplified and then passed to the filter 42, which operates to filter out frequencies which do not indicate the presence of a ferromagnetic weapon. In others words, ultra low frequencies of gradually changing magnetic fields and other undesirable direct current and ultra low frequency circuit effects are filtered out and high frequencies resulting from electronic interference are also filtered out by the filter 42. The filter 42 can be made tunable to allow the operator to adjust the filter band to accommodate for variations in the surrounding area and to compensate for the speed of the people who are passing through the detector. Any signals which are not filtered out by the filter 42 are passed to the alarm 44, which operates to notify the operator that a potential weapons has passed through the detector. The alarm 44 can notify the operator by either or both of the visual output 46, which can include a series of lights, and the audio output 48, which can include a buzzer or other audio indicator. The controller 30 can either be mounted on a nearby wall or placed on a table or other support. Alternatively, the controller 30 can be built into one of the columns 12*a* or 12*b*.

As described above, the detector 10 only reacts to a ferromagnetic object if there is relative movement between the ferromagnetic object and the coil inductive sensor 16. Therefore, the detector is less prone than the prior art to false alarms from objects placed in the proximity of the detector. For example, if a ferromagnetic wastebasket was placed next to a prior art detector, because the wastebasket could alter either the magnetic field generated by the detector or the earth's magnetic field which is monitored by the detector, the detector could signal a false alarm based on the disturbance of the magnetic field caused by the wastebasket. On the other hand, since the detector of the present invention would react only to the relative movement of the wastebasket, as soon as the wastebasket is no longer moving, the detector does not react to its presence. Therefore, the detector is less prone to false alarms. Furthermore, as described above, the design of the detector 10 enables the detector to be portable, as the columns 12*a* and 12*b* and the controller 30 can easily be carried to the desired security location.

Alternative embodiments of the invention will now be described with reference to FIGS. 4–7. A second embodiment of the detector of the present invention is generally indicated at 50 in FIG. 4. The detector 50 includes a large coil 51 formed into a loop by a wire 52 which is located within a housing 54. Both ends 56*a* and 56*b* of the wire 52 are electrically connected to a controller which is identical to the controller 30 described above. The coil 51 and housing 54 of the detector 50 preferably are approximately 6 feet high and three feet wide, to enable a person to step through the detector. Similar to the detector 10, any relative motion between a ferromagnetic object and the coil 51 induces a voltage in the coil 51, which voltage is transmitted to the controller 30 through wire ends 56*a* and 56*b*.

Figure 5:
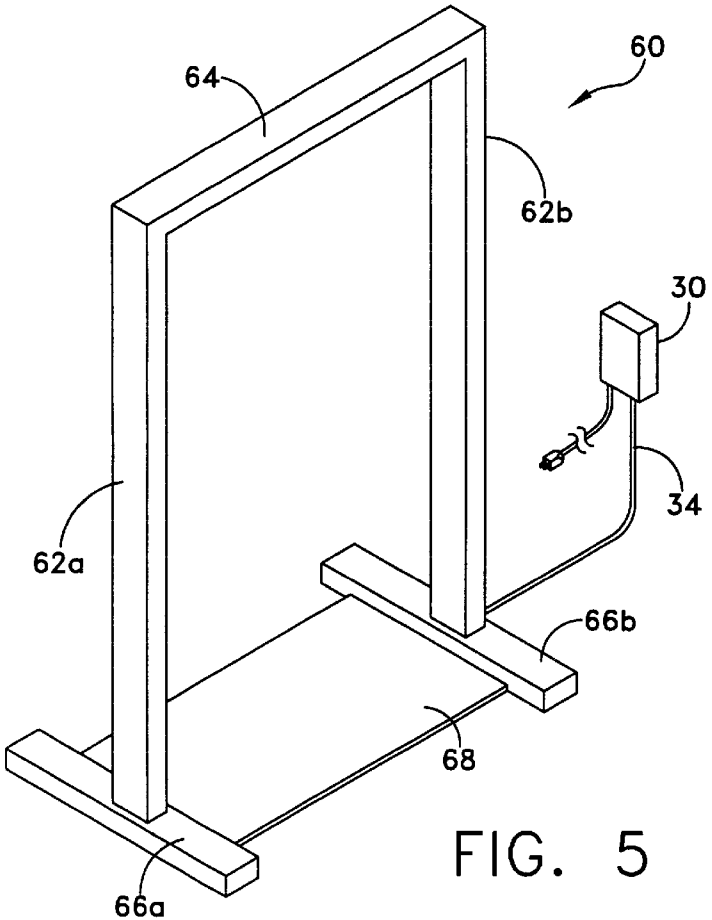
FIG. 5 is a perspective view of a third embodiment of the present invention.

A third embodiment of the invention is generally indicated at 60 in FIG. 5. This embodiment includes columns 62*a* and 62*b* connected across the tops thereof by a crosspiece 64. Columns 62*a* and 62*b* are mounted on platforms 66*a* and 66*b*, respectfully, for stability. A plate 68 interconnects the platforms 66*a* and 66*b*. The detector 60 includes a single coil inductive sensor, similar to that described with respect to FIGS. 1–3, which extends from the bottom of column 62*a* proximate platform 66*a*, upwardly through column 62*a*, across crosspiece 64 and down through to the bottom of column 62*b* proximate platform 66*b*. The beginning and end wires of the coil (not shown) are coupled to the controller 30 through the shielded cable 34. Similar to the detector 10, any relative motion between a ferromagnetic object and the coil within detector 60 induces a voltage in the coil, which voltage is transmitted to the controller 30 through the wire ends.

Figure 6:
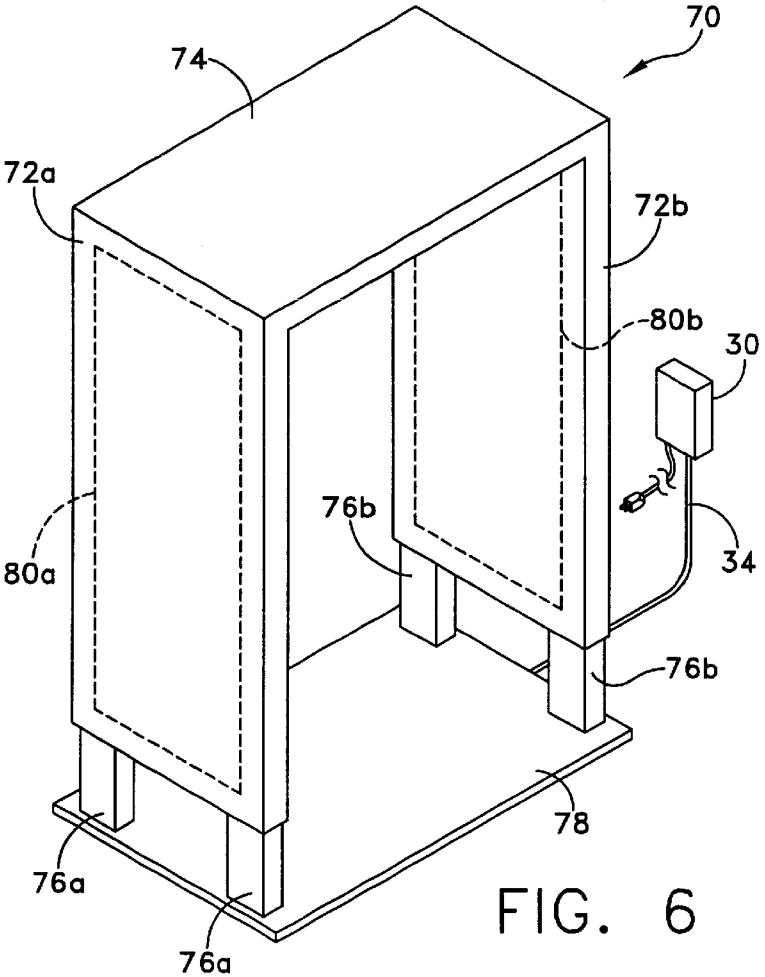
FIG. 6 is a perspective view of a fourth embodiment of the present invention.

A fourth embodiment of the invention is generally indicated at 70 in FIG. 6. This embodiment includes panels 72*a* and 72*b* connected across the tops thereof by a crosspiece 74. Panels 72*a* and 72*b* are mounted on pairs of legs 76*a* and 76*b*, respectfully, for stability. A plate 78 interconnects the legs 76*a* and 76*b*. Large single coils, shown in phantom at 80*a* and 80*b* are disposed within panels 72*a* and 72*b*, respectively. These coils are formed from a single wire into a loop, similar to the coil 51 shown in FIG. 4. The ends of the wires which form coils 80*a* and 80*b* are electrically coupled to the controller 30 through the shielded cable 34. Similar to the detector 10, any relative motion between a ferromagnetic object and the coils 80*a* and 80*b* within detector 70 induces a voltage in the coils, which voltage is transmitted to the controller 30 through the shielded cable 34.

Figure 7:
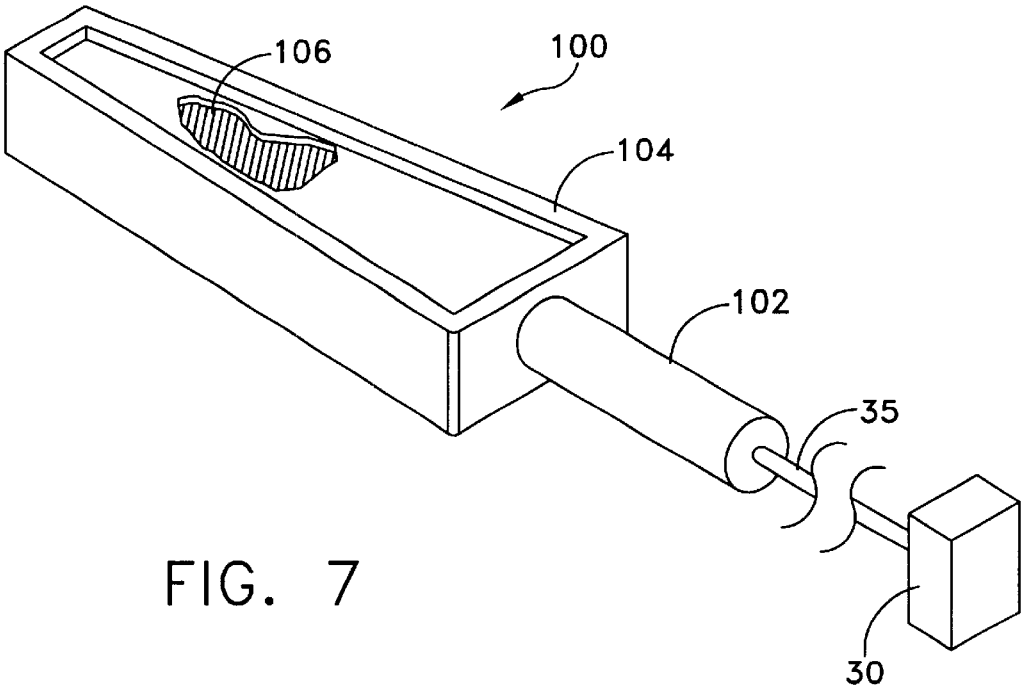
FIG. 7 is a perspective view of a fifth embodiment of the present invention, which includes a hand held device including coil inductive sensor.

A fifth embodiment of the invention is generally indicated at 100 in FIG. 7. This embodiment is a hand held version of the detector and includes a handle 102 which is coupled to an elongate housing 104. Enclosed within housing 104 is a coil inductive sensor 106 which is similar to the coil inductive sensor described with reference to FIGS. 1–3. Again, the ends of the wire which forms the sensor 106 are electrically coupled to a controller 30 through a shielded cable 35. Alternatively, the controller 30 may be built into the detector 100, which may be powered with a rechargeable battery, thus eliminating any cords from the detector 100.

Figure 1:
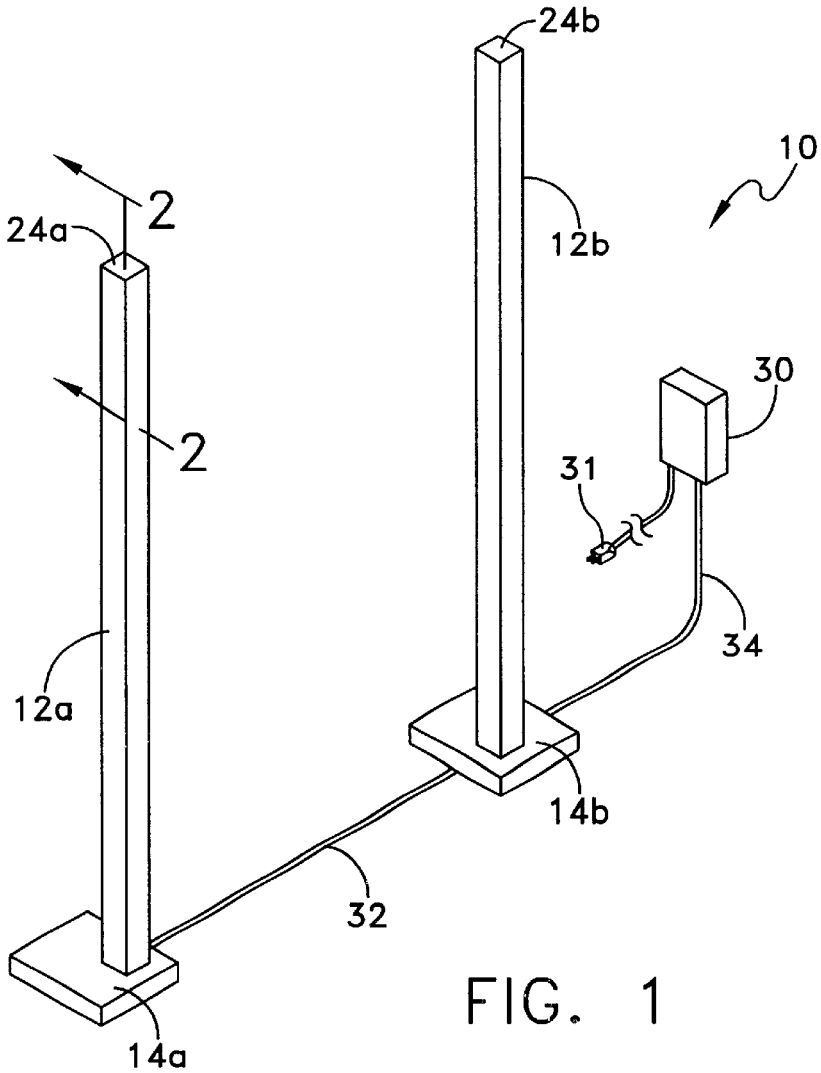
FIG. 1 is a perspective view of a first embodiment of the present invention.

The principle of operation of the detector 100 is the same as the detector 10 of FIG. 1. However, rather than the detector being still and the person passing through the detector, the person remains still and the detector is moved proximate the body of the person. As described above, any relative motion between the ferromagnetic object and the coil inductive sensor will induce a voltage in the sensor. Accordingly, if the ferromagnetic object is still, but the detector is moved past the object, a voltage will be induced in the coil inductive sensor. Once the voltage is induced in the sensor and passed to the controller, the operation of the controller is the same as described with reference to FIGS. 1–3. The filter of this single-sensor hand held detector is configured to suppress the very low frequency signals caused by the passage of the detector through the earth's magnetic field or any other ambient field and to respond to abrupt changes as the sensor passes close to a ferromagnetic object. Alternatively, the detector could be formed as a two coil sensor in which the coils are wound in a differential manner to cancel the signals caused by movement through any ambient magnetic fields and such that it responds only to ferromagnetic material which is closer to one coil than the other. In this case, the coils are typically separated by several inches and are wired as one sensor.

Based on the above, it can be seen that the present invention provides a ferromagnetic metal detector which is inexpensive to manufacture and also to operate, since the detector is passive and the only part of the detector which requires power is the controller. The detector is highly portable and is less prone to false alarms than the prior art.

Furthermore, although the invention has been described as a detector for security purposes, it will be understood that the invention may be used to detect the removal of ferromagnetic metal objects such as tools from a work site and may also be used as an anti-pilferage device in locations such as retail outlets and libraries. In this case, small, discreet magnets may be strategically placed on the goods which are to be protected, such that, if a person attempted to carry the protected object through the detector, an alarm would be actuated by the detector.

While there is shown and described herein certain specific structure embodying the invention, it will be manifest to those skilled in the art that various modifications and rearrangements of the parts may be made without departing from the spirit and scope of the underlying inventive concept. For instance, the coil inductive sensors can be oriented in any direction, i.e. vertically, horizontally, or diagonally, in order to detect lines of magnetic force which occur at varying orientations. Accordingly, the invention is not limited to the particular forms herein shown and described except insofar as indicated by the scope of the appended claims.

What is claimed is:

1. A device for detecting the presence of a ferromagnetic object, the device comprising:

at least one coil formed from a multiple winding of a wire;

a controller comprising an alarm;

a non-magnetic, conductive shield enclosing the at least one coil so as to shield said coil from high frequencies while allowing very low frequencies associated with ferromagnetic weapons moving relative to the device to pass through the shield; and wherein said at least one coil is constructed and arranged such that, upon the relative motion of the ferromagnetic object proximate said at least one coil, a voltage induced in the coil is transmitted to said controller; and wherein the at least one coil is wound onto a magnetically permeable core;

wherein said at least one coil includes a first coil and a second coil, said first and second coils being wound differentially such that the ferromagnetic object is detected only when the object is closer to one of said coils than the other of said coils; and wherein said controller is constructed and arranged to determine whether said induced voltage falls within a predetermine range and, if so, to trigger said alarm.

2. The device of claim 1, wherein said at least one coil is disposed within a vertical housing having a support platform for maintaining the coil in a vertical position.

3. The device of claim 2, comprising two coils, each being mounted in a separate housing.

4. The device of claim 3, wherein said coils are electrically coupled together and to said controller by a cable.

5. The device of claim 1, wherein said controller further comprises an amplifier and a filter for determining whether said induced voltage falls within said predetermine range.

6. The device of claim 5, wherein said alarm includes a visual output.

7. The device of claim 5, wherein said alarm includes an audio output.

8. The device of claim 1, wherein said coil comprises a loop which is constructed and arranged to allow the passage of a person therethrough.

9. The device of claim 1, wherein said coil is constructed and arranged to form an archway which enables the passage of a person thereunder.

10. The device of claim 1, wherein a first of said at least on coil is disposed within a first panel and a second of said at least on coil is disposed within a second panel, said first and second panels being mounted parallel to each other to define a passageway therebetween.

11. The device of claim 1, wherein said coil is disposed within a housing, said housing including a handle, said device being constructed and arranged to enable an operator of the device to manipulate the device by grasping said handle.

12. A device for detecting the presence of a ferromagnetic weapon, the device comprising:

an inductive sensor including a first coil and a second coil, the first and second coils being wound in a differential manner such that the ferromagnetic weapon is detected only when the object is closer to one of said first and second coils than the other of said first and second coils; and a controller electrically coupled to the coil inductive sensor, the controller including an alarm and being constructed and arranged to measure an induced electromagnetic force in the sensor; and wherein the at least one coil is wound onto a magnetically permeable core; and wherein the controller includes a filter constructed and arranged to filter out frequencies that are unrelated to the presence of a ferromagnetic weapon; wherein the filter is constructed and arranged to be selectively tunable so as to selectively adjust the filter band as desired; and wherein relative movement between the ferromagnetic weapon and the sensor proximate each other generates an induced electromagnetic force in the sensor when the ferromagnetic weapon is closer to one of the first and second coils than the other of the first and second coils, the induced electromagnetic force being transmitted to the controller for measurement thereof to determine if the induced electromagnetic force falls within a predetermined range associated with the presence of a ferromagnetic weapon, and to trigger the alarm when a ferromagnetic weapon is detected.

13. The device of claim 12, wherein the sensor is disposed within a housing, said housing including a handle, said device being constructed and arranged to enable an operator of the device to manipulate said device by grasping said handle.

14. The device of claim 12, further comprising a non-magnetic, conductive shield enclosing the at least one coil so as to shield said coil from high frequencies while allowing very low frequencies associated with ferromagnetic weapons moving relative to the device to pass through the shield.

* * * * *